United States Patent [19]

Hiraishi et al.

[11] Patent Number: 5,043,312

[45] Date of Patent: Aug. 27, 1991

[54] HEAT-SENSITIVE RECORDING MATERIAL

[75] Inventors: Shigetoshi Hiraishi; Akinori Okada, both of Tokyo; Mikiya Sekine, Warabi, all of Japan

[73] Assignee: Mitsubishi Paper Mills Limited, Tokyo, Japan

[21] Appl. No.: 608,474

[22] Filed: Nov. 2, 1990

[30] Foreign Application Priority Data

Dec. 27, 1989 [JP] Japan ..... 1-344669
Dec. 29, 1989 [JP] Japan ..... 1-343375

[51] Int. Cl.[5] ..... B41M 5/30

[52] U.S. Cl. ..... 503/208; 503/209; 503/217; 503/225

[58] Field of Search ..... 427/150-152; 503/208, 209, 216-218, 225

[56] References Cited

U.S. PATENT DOCUMENTS 3,978,270 8/1976 Glanz et al. ..... 503/202
4,521,793 6/1985 Kabashima et al. ..... 503/201

*Primary Examiner*—Bruce H. Hess
*Attorney, Agent, or Firm*—Cushman, Darby & Cushman

[57] ABSTRACT

A heat-sensitive recording material comprising a support and a heat-sensitive recording layer provided on the support, said heat-sensitive recording layer comprising an aromatic or heterocyclic isocyanate compound, an imino compound, a binder, a specific alcoholic compound, and preferably, a specific biphenyl derivative. The heat-sensitive recording material have an excellent image preservability and heat responsiveness.

9 Claims, No Drawings

HEAT-SENSITIVE RECORDING MATERIAL

This invention relates to a heat-sensitive recording material excellent in image preservability and heat responsiveness.

Generally, heat-sensitive recording materials comprise a support having provided thereon a heat-sensitive recording layer comprising as essential components an electron donating, colorless dye precursor and an electron accepting color developer. Upon heating the heat-sensitive recording material by a thermal head, a thermal pen, a laser beam or the like, the dye precursor and the color developer instantly react with each other to give recorded images. Such heat-sensitive recording materials are disclosed in Japanese Patent Application Kokoku Nos. 43-4160, 45-14039 and the like.

When such heat-sensitive recording materials are used, records can be obtained by relatively simple apparatus, the maintenance of the apparatus is easy and it is silent. Thus, the heat-sensitive recording materials are used in a wide variety of fields such as measuring recorders; facsimiles; printers; terminals of computers; labels; automatic vending machines for tickets and the like.

The heat-sensitive recording materials in which an electron donating, colorless dye precursor and an electron accepting color developer are used are advantageous in that they have good appearance and soft feel, the color density obtained is high and various hues can be obtained. However, these materials have poor record preservability for the following reasons: When the recorded area comes into contact with plastics such as polyvinyl chloride or the like, the records disappear on account of a plasticizer, an additive or the like contained in the plastics. When the recorded area comes into contact with an agent contained in a food or a cosmetic, the records disappear. The recorded images are easily discolored by sunlight exposure in a short time. At present, therefore, the use of the above heat-sensitive recording materials is limited to some fields. Thus, there has been strongly desired development of a heat-sensitive recording material free from these disadvantages.

As heat-sensitive recording materials which give recorded images having high preservability by heating the two components contained therein to react with each other, there are disclosed heat-sensitive recording materials wherein the two components are an imino-compound and an isocyanate compound in, for example, Japanese Application Kokai Nos. 58-38733, 58-54085, 58-104959, 58-149388, 59-115887, 59-115888 and U.S. Pat. No. 4,521,793.

These heat-sensitive recording materials has a sufficient preservability of recorded images. However, they are poor in heat responsiveness and hence recorded image having sufficient density can hardly be obtained with use of high-speed printers.

The present inventors have conducted extensive research in order to develop a novel heat-sensitive recording material excellent in image preservability and heat responsiveness. As a result, it has been found that the desired heat-sensitive recording material can be obtained by using a specific alcoholic compound, and preferably a heat-meltable substance.

According to the present invention, there is provided a heat-sensitive recording material comprising a support and a heat-sensitive recording layer provided on the support, said heat-sensitive recording layer comprising an aromatic or heterocyclic isocyanate compound, an imino compound, a binder and at least one alcoholic compound presented by the structural formula (1):

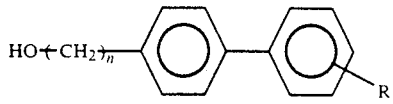

(1)

wherein R is H or alkyl and n is a positive integer [hereinafter referred to as Compound (1)].

Preferably, the heat-sensitive recording layer of the present heat-sensitive material further comprises a heat-melatble substance having a melting point of 70°-150° C.

The present invention is described in detail below.

The heat-sensitive recording material of the present heat-sensitive material comprises a support having provided thereon a heat-sensitive recording layer.

The heat-sensitive recording layer comprises an aromatic or heterocyclic isocyanate compound, an imino compound, a binder, Compound (1), and preferably, a heat-melatble substance having a melting point of 70°-150° C.

Specifically, the alcoholic compound includes 4-hydroxymethylbiphenyl, 4-hydroxyethylbiphenyl, 4-hydroxypropylbiphenyl, 4-hydroxymethyl-4'-ethylbiphenyl, 4-hydroxymethyl-4'-isobutylbiphenyl, and the like.

The alcoholic compound is contained in an amount of preferably 30-400% by weight, more preferably 40-350% by weight, further preferably 50-300% by weight, based on the weight of the isocyanate compound. When less than 30% by weight, sufficient heat responsiveness cannot be obtained. When more than 400% by weight, the contents of the isocyanate compound and the imino compound become too low, and hence, sufficient heat responsiveness cannot be obtained, either.

Specifically, the heat-meltable substance having a melting point of 70°-150° C. includes stearamide, palmitamide, N-methylolstearamide, benzyl p-benzyloxybenzoate, phenyl 1-hydroxy-2-naphthoate, β-naphthyl benzyl ether, β-naphtyl p-chlorobenzyl ether, β-naphthyl p-methylbenzyl ether, 1,4-butanediol p-methylphenyl ether, diethylene glycol bis(4-methoxyphenyl) ether, 1,2-bis(4-methoxyphenylthio)ethane, 1,4-butanediol phenyl ether, N-stearylurea, N,N'-distearylurea, phenyl β-naphthoate, phenyl 1-hydroxy-2-naphthoate, 1,4-dimethoxynaphthalene, 1-methoxy-4-benzyloxynaphthalene, dimethylterephthalate, 1-phenoxy-2-(4-chlorophenoxy) ethane, and the like.

However, the heat-meltable substance is preferably a biphenyl derivative represented by the structural formula (2):

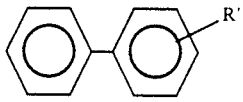

(2)

wherein R' is aralkyl or aryl [hereinafter referred to as Compound (2)]. The biphenyl derivative specifically includes 4-benzylbiphenyl, 4-phenethylbiphenyl, m-terphenyl and the like.

The heat-meltable substance may be used alone or in combination of two or more. The heat-meltable substance is contained in an amount of preferably 5–400% by weight, more preferably 10–350% by weight, based on the weight of the isocyanate compound.

When Compound (1) and the heat-meltable substance such as Compound (2) are used in combination, heatresponsiveness can be remarkably improved compared with the case in which they are used alone. Compound (1) and the heat-meltable substance can be mixed in any method. For example, there may be empolyed a method in which they are indivisually pulverized and then mixed with each other, a method in which they are mixed with each other and then pulverized, and a method in which they are molten by heat and mixed enough and then cooled followed by pulverization.

The aromatic or heterocyclic isocyanate compound used in this invention is colorless or pale colored substances and solid at room temperature. Specifically, the aromatic or heterocyclic isocyanate compound includes 2,6-dichlorophenylisocyanate, p-chlorophenylisocyanate, 1,3-phenylenediisocyanate, 1,4-phenylenediisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5-diethoxybenxene-1,4-diisocyanate, 2,5-dibutoxybenzene-1,4-diisocyanate, azobenzene-4,4'-diisocyanate, diphenyl ether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethylbiphenyl-4,4'-diisocyanate, 3,3'-dimethoxybiphenyl-4,4'-diisocyanate, diphenylmethane4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate 4,4',4''-triisocyanato-2,5-dimethoxytriphenylamine, p-dimethylaminophenylisocyanate, tris(4-phenylisocyanato)thiophosphate and the like. These isocyanate compounds may be used alone or in combination of two or more. If necessary, these may be used in the form of a so-called block isocyanate, which is an adduct with a phenol, a lactam, an oxime or the like. A dimer of diisocyanate such as a dimer of 1-methylbenzene-2,4-diisocyanate; an isocyanurate, which is a trimer of isocyanate may also be used. However, the effects of this invention may not be obtained enough when all isocyanate groups are blocked.

The imino compound used in this invention is a compound which has at least one >C=NH group and is represented by the following general formula:

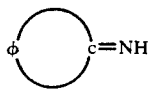

wherein ϕ represents an aromatic compound residue which can form a conjugate system with C=N adjacent thereto. The imino conpound is colorless or pale colored and solid at room temperature. If necessary, the imino compound may be used in combination of two or more. The imino conpound includes 3-iminoisoindoline-1-one, 3-imino-4,5,6,7-tetrachloroisoindoline-1-one, 3-imino-4,5,6,7-tetrabromoisoindoline-1-one, 3-imino-4,5,6,7-tetrafluoroisoindoline-1-one, 3-imino-5,6-dichloroisoindoline-1-one, 3-imino-4,5,7-trichloro-6-methoxyisoindoline-1-one, 3-imino-4,5,7-tricholoro-6-methylmercaptoisoindoline-1-one, 3-imino-6-nitroisoindoline-1-one, 3-iminoisoindoline-1-spirodioxolan, 1,1-dimethoxy-3-iminoisoindoline, 1,1-diethoxy-3-imino-4,5,6,7-tetrachloroisoindoline, 1-ethoxy-3-iminoisoindoline, 1,3-diiminoisoindoline, 1,3-diimino-4,5,6,7-tetrachloroisoindoline, 1,3-diimino-6-methoxyisoindoline, 1,3-diimino 6-cyanoisoindoline, 1,3-diimino-4,7-dithia-5,5,6,6-tetrahydroisoindoline, 7-amino-2,3-dimethyl-5-oxopyrrolo[3,4-b]pyrazine, 7-amino-2,3-diphenyl-5-oxopyrrolo[3,4-b]pyrazine, 1-iminonaphthalimide, 1-iminodiphenimide, 1-phenylimino-3-iminoisoindoline, 1-3'-chlorophenylimino)-3-iminoisoindoline, 1-(2',5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'-dimethoxyphenylimino)-3-iminoisoindoline, 1-(2',5'-diethoxyphenylimino)-3-iminoisoindoline, 1-(2'-methyl-4'-nitrophenylimino)-3-iminoisoindoline, 1-(5'chloro-2'-phenoxyphenylimino)-3-iminoisoindoline, 1-(4'N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylphenylimino)-3-iminoisoindoline, 1-(2'-chloro-5'-trifluoromethylphenylimino)-3-iminoisoindoline, 1-(5',6'-dichlorobenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-3'-imino)3-iminoisoindoline, 1 (naphthoquinone-1'-imino)-3-iminoisoindoline, 1-(pyridyl-4'-imino)-3-iminoisoindoline, 1-(benzimidazolone-6'-imino)-3-iminoisoindoline, 1-(1'-methylbenzimidazolone-6'-imino)-3-iminoisoindoline, 1-(7,-chlorobenzimidazolone-5'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrazone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,6,7-tetrafluoroisoindoline, 1-benzimidazolyl-2'-imino)-3-imino-4,7-dithiatetrahydroisoindoline, 1-(4',5'-dicyanoimidazolyl-2'-imino)-3-imino-5,6-dimethy-1-4,7-pyradiisoindoline, 1-(cyanobenzoylmethylene)-3-iminoisoindoline, 1-(cyanocarboxamidomethylene) 3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-[cyano-N-(3'-methylphenyl)-carbamoylmethylene]-3-iminoisoindoline, 1-[cyano-N-(4'-chlorophenyl)carbamoylmethylene]-3-iminoisoindoline, 1 [cyano-N-(4'-methoxyphenyl)carbamoylmethylene]-3-iminoisoindoline, 1-[cyano-N-(3'-chloro-4'-methylphenyl)carbamoylmethylene]-3-iminoisoindoline, 1-(cyano-p-nitrophenylmethylene)-3-iminoisoindoline, 1-(dicyanomethylene)-3-iminoisoindoline, 1-(cyano-1',2',4'- triazolyl-(3')-carbamoylmethylene)-3-iminoisoindoline, 1-(cyanothiazolyl-(2carbamoylmethylene)-3-iminoisoindoline, 1-(cyanobenzimidazolyl-(2')-carbamoylmethylene)-3-iminoisoindoline, 1-(cyanobenzothiazolyl-(2')-carbamoylmethylene)-3-iminoisoindoline, 1-[cyano-benzimidazolyl-2'methylene]-3-iminoisoindoline, 1-[(cyanobenzimidazolyl-2')-methylene]-3-imino-4,5,6,7-tetrachloroisoindoline, 1-[(cyanobenzimidazolyl-2')-methylene]-3-imino-5-methoxyisoindoline, 1-[(cyanobenzimidazolyl-2')-methylene]-3-imino-6-chloroisoindoline, 1-[(1'-phenyl)-3'-methyl-5-oxo-pyrazolidene-4']-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino-5,6-dimethyl-4,7 pyradiisoindoline, 1-[(1'-methyl-3'-n-butyl-barbituric acid-5']3-iminoisoindoline, 3-imino-1-sulfobenzimide, 3-imino-1-sulfo-6-chlorobenzoimide, 3-imino-1-sulfo-5,6-dichlorobenzimide, 3-imino 1-sulfo-4,5,6,7-tetrachlorobenzimide, 3-imino-1-sulfo-4,5,6,7-tetrachlorobenzimide, 3-imino-1-sulfo-4,5,6,7-tetrafluorobenzimide, 3-imino-1-sulfo-6-nitrobenzimide, 3-imino-1-sulfo-6-methoxybenzimide, 3-imino-1-sulfo-4,5,7-trichloro-6-methylmeercaptobenzimide, 3-imino-1-sulfonaphthimide, 3-imino-1-sulfo-5-bromonaphthimide, 3-imino-2 methyl-4,5,6,7-tetrachloroisoindoline 1-one and the like.

As described above, the heat-sensitive recording material of this invention comprises a support having provided thereon a heat-sensitive recording layer which forms color upon heating. As the support, mainly used is paper; however, there may also be used various non-woven fabrics, synthetic resin film, laminated paper, synthetic paper, metal foil, a composite sheet consisting of a combination of them, or the like depending upon the purpose.

The heat-sensitive recording layer may have a single-layered structure or multi-layered structure. In case of multi-layered structure, an intermediate layer may be provided between each layer. Moreover, a protecting layer may be provided on the surface of the heat-sensitive recording layer. The heat-sensitive recording layer can be formed by coating the support with coating compositions obtained by mixing aqueous dispersions containing each coloring component pulverized therein, with the binder and the like. In this case, for example, each aqueous dispersion can be indivisually coated on the support to form multi-layered structure in which each layer contains one coloring component.

Furthermore, the heat-sensitive recording layer may further contain an aniline derivative having at least one amino group as disclosed in PCT/JP81/00300 filed by the present applicant. When the aniline derivative is contained, fogging is prevented more effectively.

Specifically, the aniline derivative includes methyl p-aminobenzoate, ethyl p-aminobenzoate, n-propyl p-aminobenzoate, isopropyl p-aminobenzoate, butyl p-aminobenzoate, dodecyl p-aminobenzoate, benzyl p-aminobenzoate, o-aminobenzophenone, m-aminoacetophenone, p-aminoacetophenon, m-aminobenzamide, o-aminobenzamide, p-aminobenzamide, p-amino-N-methylenzamide, 3-amino-4-methylbenzamide, 3-amino-4-methoxybenzamide, 3-amino-4-chlorobenzamide, p-(N-phenylcarbamoyl)aniline, p-[N-(4chlorophenyl)carbamoyl]aniline, p-[N-(4-aminophenyl)carbamoyl]aniline, 2-methoxy-5-(N-phenylcarbamoyl)aniline, 2-methoxy-5-[N-(2'-methyl-3'-chlorophenyl)carbamoyl]aniline, 2-methoxy-5-[N-(2'-chlorophenyl)carbamoyl]aniline, 5-acetylamino-2-methoxyaniline, 4-acetylaminoaniline, 4-(N-methyl-N-acetylamino)aniline, 2,5-diethoxy-4-(N-benzoylamino)aniline, 2,5-dimethoxy-4-(N-benzoylamino)aniline, 2-methoxy-4-(N-benzoylamino)-5-methylamiline 4-sulfamoylaniline, 3-sulfamoylaniline, 2-(N-ethyl-N-phenylaminosulfonyl)aniline, 4-dimethylaminosulfonylaniline, 4-diethylaminosulfonylaniline, sulfathiazole, 4-aminodiphenylsulfone, 2-chloro-5 N-phenylsulfamoylaniline, 2-methoxy-5-N,N-diethylsulfamoylaniline, 2,5-dimethoxy-4-N-phenylsulfamoylaniline, 2-methoxy-5-benzylsulfonylaniline, 2-phenozysulfonylaniline, 2-(2'-chlorophenoxy)sulfonylaniline, 3-anilinesulfonyl-4-methylaniline, bis[4-(m-aminophenoxy)phenyl]sulfone, bis[4-(p-aminophenoxy)phenyl]sulfone, bis[3-methyl-4-(pamino-phenoxy)phenyl]sulfone, 3,3'-dimethoxy-4,4'-diamonobiphenyl, 3,3'-dimethyl-4,4'-diaminobiphenyl, 2,2'-dichloro-4,4'-diamino-5,5'-dimethoxybiphenyl, 2,2',5,5'-tetrachloro-4,4'-diaminobiphenyl, o-tolidinesulfone, 2,4'-diaminobiphenyl, 4,4-diaminobiphenyl, 2,2'-dichloro-4,4'-diaminobiphenyl, 3,3'-dichloro-4,4'-diaminobiphenyl, 2,2'-dimethyl-4,4'-diaminobiphenyl, 4,4'-thiodianiline, 2,2'-dithiodianiline, 4,4'-dithiodianiline, 4,4'-diaminodiphenyl ether, 3,3'-diaminodiphenyl ether, 3,4'-diaminodiphenyl ether, 4,4'-diaminodiphenylmethane, 3,4'-diaminodiphenylmethane, bis(3-amino-4-chlorophenyl)sulfone, bis(3,4-diaminophenyl)-sulfone, bis(4-aminophenyl)sulfone, sulfone, bis(3-aminophenyl)sulfone, 3,4'-diaminodiphenylsulfone, 3,3'-diaminodiphenylmethane, 4,4'-ethylenedianiline, 4,4'-diamino-2,2'-dimethylbenzyl, 4,4'-diamino-3,3'-dichlorodiphenylmethane 3,3'-diaminobenzophenone, 4,4'-diaminobenzophenone, 1,4bis(4-aminophenoxy)-benzene, 1,3-bis(4-aminophenoxy)benzene, 1,3-bis(3-aminophenoxy)benzene, 9,9bis(4-aminophenyl)fluorene, 2,2-bis(4-aminophenoxyphenyl)propane, 4,4'-bis(4-aminophenoxy)diphenyl, 3,3',4,4'-tetraaminodiphenyl ether, 3,3',4,4'-tetraaminodiphenylsulfone, 3,3',4,4'-tetraaminobenzophenone, and the like.

As the binder, there may be mentioned water-soluble binders such as starches, hydroxyethylcellulose, methylcellulose, carboxymethylcellulose, gelatin, casein, polyvinyl alcohol, modified polyvinyl alcohol, styrene-maleic anhydride copolymer and ethylene-maleic anhydride copolymer; latex type, water-insoluble binders such as styrene-butadiene copolymer, acrylonitrilebutadiene copolymer and methyl acrylate-butadiene copolymer; etc.

Furthermore, the heat-sensitive recording layer may contain a pigment such as diatomaceous earth, talc, kaolin, calcined kaolin, calcium carbonate, magnesium carbonate, titanium oxide, zinc oxide, silicon oxide, aluminium hydroxide, urea-formaldehyde resin, and the like.

For the purpose of prevention of head abrasion, sticking, and the like, if necessary, the heat-sensitive recording layer may further contain a metal salt of a higher fatty acid such as zinc stearate or calcium stearate; a wax such as paraffin, oxidized paraffin, polyethylene, oxidized polyethylene, stearamide or castor wax; a dispersant such as sodium dioctylsulfosuccinate; an ultraviolet-ray absorbent of benzophenone type, benzotriazole type or the like; a surfactant; a fluorescent dye; and the like.

The following Examples further illustrate the present invention.

EXAMPLE 1

15 g of 1,3-diimino-4,5,6,7-tetrachloroisoindoline was added to 60 g of a 1% aqueous solution of polyvinyl alcohol. The resulting mixture was pulverized in a ball mill for 24 hours to obtain Dispersion 1.

10 g of 4,4',4''-triisocyanato-2,5-dimethoxytriphenylamine was added to 40 g of a 1% aqueous solution of polyvinyl alcohol. The resulting mixture was pulverized in a ball mill for 24 hours to obtain Dispersion 2.

0.4 g of 2-methoxy-N,N-diethylsulfamoylaniline was added to 20 g of a 1% aqueous solution of polyvinyl alcohol. The resulting mixture was pulverized in a ball mill for 24 hours to obtain Dispersion 3.

21 g of 4-hydroxymethylbiphenyl and 4 g of m-terphenyl were added to 125 g of a 1% aqueous solution of polyvinyl alcohol. The resulting mixture was pulverized in a ball mill for 24 hours to obtain Dispersion 4.

All of the dispersions obtained above were mixed with one another. To the dispersion mixture were added 125 g of a 40% aqueous dispersion of calcium carbonate, 50 g of a 30% aqueous dispersion of zinc stearate, 135 g of a 10% aqueous solution of polyvinyl alcohol and 90 g of water, and stirred enough to obtain a coating composition.

The coating composition was coated on a sheet of base paper 50 g/m$^2$ in basis weight so as to provide a heat-sensitive recording layer in a proportion of 5.2 g/m$^2$ in terms of solid content. Thus coated paper was dried and then subjected to supercalender treatment to obtain a heat-sensitive recording material.

EXAMPLE 2

The same procedure as in Example 1 was repeated, except that Dispersions 4 and 5 were prepared as follows and a coating composition was obtained using Dispersions 1–5.

6.25 g of 4-hydroxymethylbiphenyl was added to 31 g of a 1% aqueous solution of polyvinyl alcohol. The resulting mixture was pulverized in a ball mill for 24 hours to obtain Dispersion 4.

18.75 g of 4-benzylbiphenyl was added to 94 g of a 1% aqueous solution of polyvinyl alcohol. The resulting mixture was pulverized in a ball mill for 24 hours to obtain Dispersion 5.

EXAMPLE 3

The same procedure as in Example 2 was repeated, except that 12.5 g of 4-hydroxymethylbiphenyl and 62.5 g of a 1% aqueous solution of polyvinyl alcohol were used to obtain Dispersion 4, and 12.5 g of 4-benzylbiphenyl and 62.5 g of a 1% aqueous solution of polyvinyl alcohol were used to obtain Dispersion 5.

EXAMPLE 4

The same procedure as in Example 2 was repeated, except that 18.75 g of 4-hydroxymethylbiphenyl and 94 g of a 1% aqueous solution of polyvinyl alcohol were used to obtain Dispersion 4, and 6.25 g of 4-benzylbiphenyl and 31 g of a 1% aqueous solution of polyvinyl alcohol were used to obtain Dispersion 5.

EXAMPLE 5

The same procedure as in Example 1 was repeated, except that, instead of 21 g of 4-hydroxymethylbiphenyl and 4 g of m-terphenyl, 25 g of 4-hydroxymethylbiphenyl was used to obtain Dispersion 4.

COMPARATIVE EXAMPLE 1

The same procedure as in Example 1 was repeated, except that, instead of 21 g of 4-hydroxymethylbiphenyl and 4 g of m-terphenyl, 25 g of m-terphenyl was used to obtain Dispersion 4.

COMPARATIVE EXAMPLE 2

The same procedure as in Example 1 was repeated, except that, instead of 21 g of 4-hydroxymethylbiphenyl and 4 g of m-terphenyl, 25 g of 4-benzylbiphenyl was used to obtain Dispersion 4.

COMPARATIVE EXAMPLE 3

The same procedure as in Example 1 was repeated, except that, instead of 21 g of 4-hydroxymethylbiphenyl and 4 g of m-terphenyl, 25 g of 2-benzyloxynaphthalene was used to obtain Dispersion 4.

COMPARATIVE EXAMPLE 4

The same procedure as in Example 1 was repeated, except that, instead of 21 g of 4-hydroxymethylbiphenyl and 4 g of m-terphenyl, 25 g of di(4-chlorobenzyl) oxalate was used to obtain Dispersion 4.

COMPARATIVE EXAMPLE 5

The same procedure as in Example 1 was repeated, except that Dispersion 4 was eliminated and the heat-sensitive recording layer was provided in a proportion of 4.2 g/m$^2$ in terms of solid content.

The heat-sensitive recording materials obtained above were evaluated as follows:

Test 1 (heat responsiveness)

On the heat-sensitive material, printing was carried out by a heat-sensitive facsimile printing tester at an applied pulse of 1.0 msec or 1.4 msec and an applied voltage of 22.0 V. The optical density of the image thus printed was measured by a Macbeth RD918 type densitometer.

Test 2 (image preservability)

On the image printed on the heat-sensitive recording material, a sheet of polyvinyl chloride was superposed and pressure of 300 g/m$^2$ was applied thereto. Keeping the pressure applied, they were stored at 40° C. for 24 hours. And then the optical density of the image was measured in the same manner as in Test 1. Image preservability was calculated by the following formula:

$$\text{Image preservability (\%)} = 100 \times \frac{\text{Optical density of image after storage}}{\text{Optical density of image before storage}}$$

The results obtained above are shown in Table.

TABLE

| | Heat responsiveness | | Image preservability |
|---|---|---|---|
| | At 1.0 msec | At 1.4 msec | % |
| Example 1 | 0.82 | 1.06 | 100 |
| Example 2 | 0.87 | 1.05 | 100 |
| Example 3 | 0.86 | 1.08 | 100 |
| Example 4 | 0.87 | 1.06 | 100 |
| Example 5 | 0.79 | 1.04 | 100 |
| Comparative | | | |
| Example 1 | 0.64 | 0.98 | 100 |
| Example 2 | 0.71 | 1.00 | 100 |
| Example 3 | 0.68 | 0.96 | 100 |
| Example 4 | 0.45 | 0.83 | 100 |
| Example 5 | 0.32 | 0.61 | 100 |

As is clear from these results, the heat-sensitive materials of the present invention have excellent image preservability and heat responsiveness, because the heat-sensitive recording layer comprises the alocoholic compound, and optionally the heat-meltable substance.

What is claimed is:

1. A heat-sensitive recording material comprising a support and a heat-sensitive recording layer provided on the support, said heat-sensitive recording layer comprising an aromatic or heterocyclic isocyanate compound, an imino compound, a binder and at least one alcoholic compound presented by the structural formula (1):

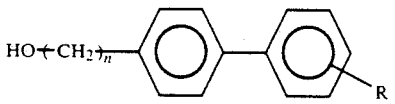

(1)

wherein R is H or alkyl and n is a positive integer.

2. A heat-sensitive recording material according to claim 1, wherein the alcoholic compound is 4-hydroxymethylbiphenyl, 4-hydroxyethylbiphenyl, 4-hydroxypropylbiphenyl, 4-hydroxymethy-4'-ethylbiphenyl or 4-hydroxymethy-4'-isobutylbiphenyl.

3. A heat-sensitive recording material according to claim 1, wherein the alcoholic compound is contained in an amount of 30–400% by weight based on the weight of the isocyanate compound.

4. A hear-sensitive recording material according to claim 1, wherein the alcoholic compound is contained in an amount of 40–350% by weight based on the weight of the isocyanate compound.

5. A heat-sensitive recording material according to claim 1, wherein the heat-sensitive recording layer further comprises at least one heat-meltable substance having a melting point of 70°–150° C.

6. A heat-sensitive recording material according to claim 5, wherein the heat-meltable substance is a biphenyl derivative represented by the structural formula (2):

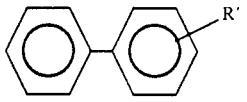

(2)

wherein R' is aralkyl or aryl.

7. A heat-sensitive recording material according to claim 6, wherein the heat-meltable substance is 4-benzylbiphenyl, 4-phenethylbiphenyl or m-terphenyl.

8. A heat-sensitive recording material according to claim 6, wherein the heat-meltable substance is contained in an amount of 5–400% by weight based on the weight of the isocyanate compound.

9. A heat-sensitive recording material according to claim 6, wherein the heat-meltable substance is contained in an amount of 10–350% by weight based on the weight of the isocyanate compound.

* * * * *